US005153548A

United States Patent [19]

Hourtane et al.

[11] Patent Number: 5,153,548

[45] Date of Patent: Oct. 6, 1992

[54] VARIABLE INDUCTOR

[75] Inventors: Jean-Luc Hourtane, Frepillon; Jacques Guillard, Le Chesnay, both of France

[73] Assignee: Alcatel Cable, France

[21] Appl. No.: 666,990

[22] Filed: Mar. 11, 1991

[30] Foreign Application Priority Data

Mar. 12, 1990 [FR] France ..... 90 03114

[51] Int. Cl.[5] ..... H01F 29/02

[52] U.S. Cl. ..... 336/144

[58] Field of Search ..... 336/137, 139, 140, 141, 336/144, 149; 323/264, 340

[56] References Cited

U.S. PATENT DOCUMENTS

| | | | |
|---|---|---|---|
| 2,451,809 | 10/1948 | Clark | 336/144 |
| 2,477,693 | 8/1949 | Guanella | 336/138 |
| 2,764,742 | 9/1956 | Cady et al. | 336/144 |
| 2,781,514 | 2/1957 | Sichak et al. | 336/144 |
| 2,819,454 | 1/1958 | Yost, Jr. et al. | 336/144 |
| 2,978,600 | 4/1961 | Silverman . | |
| 3,514,553 | 5/1970 | Penney, Jr. et al. . | |

FOREIGN PATENT DOCUMENTS 0077240 4/1983 European Pat. Off. .

*Primary Examiner*—Thomas J. Kozma

*Attorney, Agent, or Firm*—Sughrue, Mion, Zinn, Macpeak & Seas

[57] ABSTRACT

A variable inductor provided with an inlet electrode and an outlet electrode, and including an inductive section having one end connected to the inlet electrode, electrically conductive moving equipment being provided with a moving contact for establishing a connection with the inductor section and being provided with means for connection to the outlet electrode, the inductor being wherein the moving contact is disposed in the proximity of the inductive section, with the connection therebetween is established by means of an electric arc.

3 Claims, 1 Drawing Sheet

VARIABLE INDUCTOR

The present invention relates to a variable inductor.

BACKGROUND OF THE INVENTION

Variable inductors are generally made from coils of conductor wires. To vary the inductance of such an inductor, a first solution consists in disposing a moving magnetic core in the center of the coil. A second solution, which is applicable particularly when the coil is merely a helix, consists in using a moving conductor component having one end which slides over the helix and whose other end constitutes one of the terminals of the variable inductor, with the other terminal of the variable inductor being constituted by one of the ends of the helix. These two types of embodiment are ill-suited to high power applications as occur, for example, in high energy pulse generators operating at voltages greater than 10 kV and at currents greater than 1 kA. It is not possible to use a moving core at very high currents because the magnetic material constituting it saturates.

It is also impossible to make a sliding contact for currents greater than a few hundred amps, since heating due to the passage of the current gives rise to surface melting of the two portions in contact, and consequently welds them together.

An object of the present invention is thus to provide a high power variable inductor. Such an inductor makes it possible, in particular, to vary certain characteristics of high energy pulse generators continuously, e.g. rise time.

SUMMARY OF THE INVENTION

The present invention provides a variable inductor provided with an inlet electrode and an outlet electrode, and including an inductive section having one end connected to said inlet electrode, electrically conductive moving equipment being provided with a moving contact for establishing a connection with said inductor section and being provided with means for connection to said outlet electrode, wherein said moving contact is disposed in the proximity of said inductive section, with the connection therebetween being established by means of an electric arc.

In one embodiment of the variable inductor, the inductive section is a segment of a helix.

In addition, in the variable inductor, the moving equipment comprises a portion of a circular cylindrical tube sharing the same axis as said helix, said moving contact being a circular projection on the inside face of said tube, the inside diameter of said projection being greater than the outside diameter of said helix.

Advantageously, in the variable inductor said means for connection to the outlet electrode comprise a return contact disposed in the proximity of said outlet electrode, the connection therebetween being established by means of an electric arc.

Further, in the variable inductor, the outlet electrode is a cylindrical bar.

In addition, in the variable inductor, said moving equipment includes a circular section having the same axis as said cylindrical bar, said return contact projecting from the inside face of said cylindrical section whose distance from the axis of said cylindrical bar is greater than the radius of said bar.

In a preferred embodiment, the helix and the cylindrical bar share the same axis and have the same diameter, the moving equipment being a segment of a circular cylinder carrying the moving contact and the return contact.

Advantageously, the variable inductor is contained in a gastight enclosure containing a dielectric gas.

BRIEF DESCRIPTION OF THE DRAWING

An embodiment of the invention is described by way of example with reference to the accompanying drawing, in which.

MORE DETAILED DESCRIPTION

Figure 1:
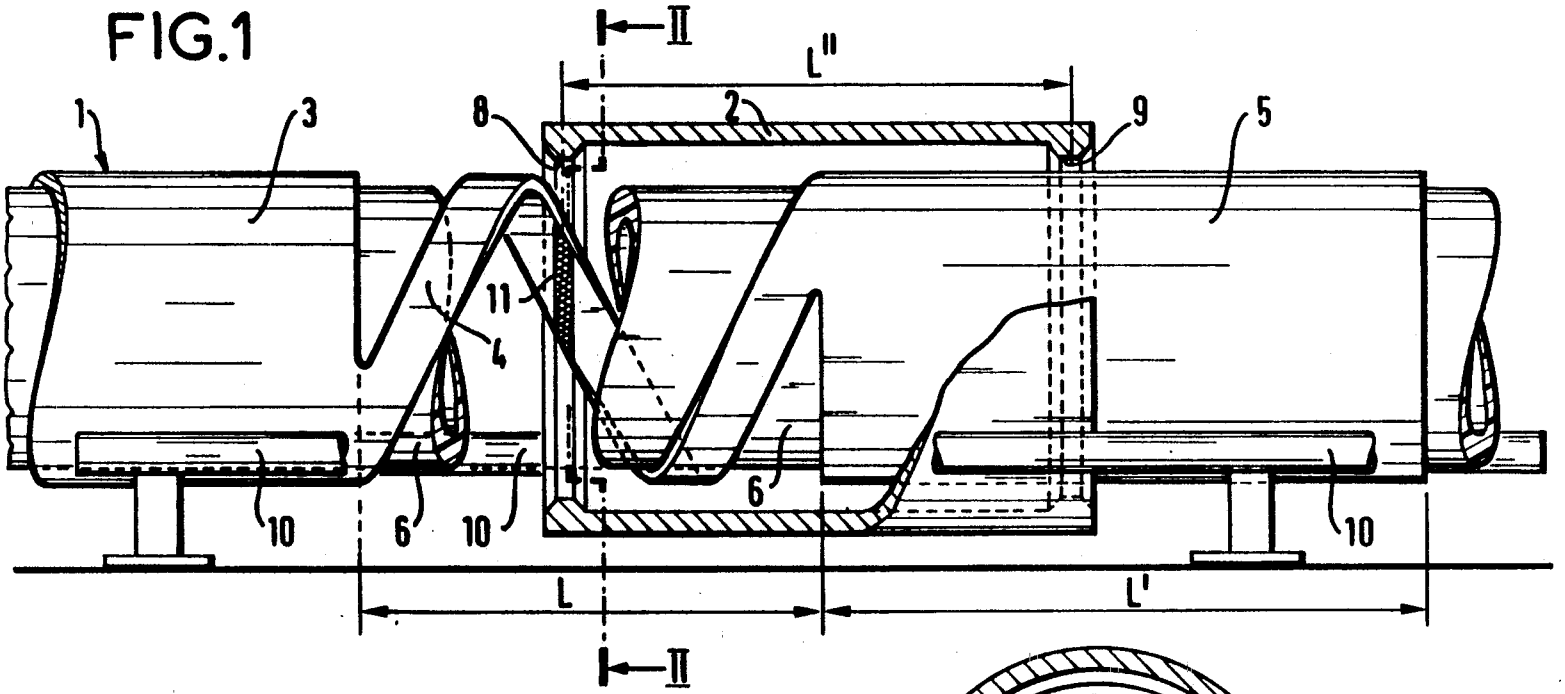
FIG. 1 is a partially cutaway side view of a variable inductor of the invention.

Items which appear in both figures are given the same reference numerals.

Figure 2:
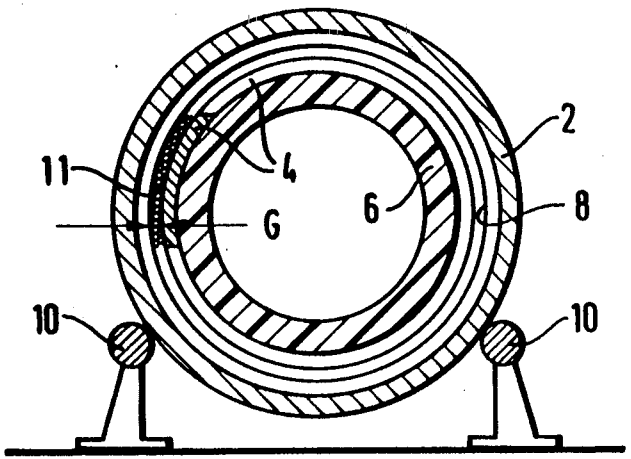
FIG. 2 is a section view through said variable inductor.

The variable inductor shown in side view in FIG. 1 and in section in FIG. 2 essentially comprises a fixed body 1 and moving equipment 2.

The body 1 of the inductor is based on a tubular cylindrical structure of circular section. It comprises an inlet electrode 3 which has a previously defined circular section formed in an electrically conductive material. Following the inlet electrode 3, there is an inductive section 4 which is a segment of a helix inscribed in the same cylinder and likewise made of a conductive material having one end connected to the inlet electrode 3. Following the inductive section 4 of length L, there is an outlet electrode 5 which is a section of the same cylinder and which is of length L', where L' is greater than L, and is likewise made of conductive material.

The body 1 also includes a core 6 of electrically insulating material. This core is a solid or hollow cylinder of circular section whose outside diameter is slightly less than the inside diameter of the electrodes 3 and 5 and of the inductive section 4. It constitutes a support for the segment of helix 4 and it is received in the inlet electrode 3 and in the outlet electrode 5.

The body 1 may be integrally machined from a single bar. It is also possible to make the two electrodes 3 and 5 separately and to make the segment of helix 4 separately and then to assemble these components together, e.g. by soldering.

The moving equipment 2 provides an gap C, FIG. 2, of a electrical connection between a point on the inductive section 4 and the outlet electrode 5. It comprises a moving contact that moves over said inductive section, and means for connecting it to the outlet electrode. It is made from a cylindrical tube of circular section which fits over the body 1, with the axes of these items coinciding. The tube includes a radial projection 8 on its inside face constituting a body of revolution about the axis of the tube. The inside diameter of this projection is greater than the outside diameter of the segment of helix 4 by a few millimeters, for example. It constitutes the moving contact. The means connected to the outlet electrode 5 may be constituted by any conventional means, and in particular by a flexible connection. In the context of this embodiment, these means are implemented similarly to the moving contact 8, but it should be understood that the invention is not limited to this configuration. These means thus comprise a further projection constituting a return contact 9 and likewise disposed on the inside face of the tube. Although similar to the moving contact 8, it is not essential for this contact to be a body of revolution. For example, it may constitute a circular sector whose distance from the axis is substantially the same as that of the moving contact. These two projections are spaced apart by a distance L'' which is not less than L.

The moving equipment 2 rests on a support 10. The function of this support is to ensure that the axes of the body 1 and of the moving equipment 2 remain colinear, and it may be made, for example, using slideways or rows of balls parallel to said axes.

The moving equipment 2 is designed to be displaced in translation by a device which is not shown, but which could be constituted, in particular, by a system of hydraulic or pneumatic actuators. The device serves to displace the moving equipment 2 in such a manner as to cause the moving contact 8 overlying the segment of helix 4 to remain between two extreme positions, one in the vicinity of the inlet electrode 3 and the other in the vicinity of the outlet electrode 5. The length of the outlet electrode 5 is L' where L'>L'' so that when in this position it faces the return contact 9.

The connection between the moving contact 8 and the segment of helix 4, and the connection between the return contact 9 and the outlet electrode 5 both take place via respective electric arcs. The trigger voltage depends on the distance between the two facing elements and on the dielectric present at said location. For a separation distance of a few millimeters, this voltage is of the order of a few kV. The current through the moving contact 8 flows through a contact area 11 which corresponds substantially to the outside surface of a portion of the segment of helix 4 as delimited by the radial projection of said moving contact 8. This contact area is constant regardless of the position of the moving contact between the two electrodes 3 and 5. It is dimensioned as a function of the current to be conveyed. In addition, it determines the geometry of the return contact 9 in such a manner as to avoid it constituting a brake on the flow of current.

The inductance of the above-described inductor thus varies as a function of the relative position between the moving equipment 2 and the body 1. The trigger voltage required for operating it is not a limitation in applications where the voltages in use are several hundreds of kV.

The variable inductor is advantageously inserted inside a gastight enclosure filled with a dielectric gas such as sulfurhexafluoride.

We claim:

1. A variable inductor provided with an inlet electrode, an outlet electrode and an inductive section integrally connected to said inlet electrode and outlet electrode at opposite ends thereof and having a common axis and diameter, electrically conductive moving equipment including a moving contact for establishing a connection with said inductive section and further having means for electrical connection to said outlet electrode, said moving contact being disposed in the proximity of said inductive section and including a first gap between said moving contact and said inductive section forming an electrical connection therebetween by means of an electric arc across said first gap, said inductive section constituting a segment of a helix, said moving equipment comprising a portion of a circular cylindrical tube sharing the same axis as said helix, said moving contact being a circular projection on the inside face of said tube, the inside diameter of said projection being greater than the outside diameter of said helix and forming said first gap therebetween, said means for electrical connection to said outlet electrode comprising a return contact disposed in proximity of said outlet electrode, including a second gap forming an electrical connection therebetween by means of an electric arc across said second gap.

2. A variable inductor according to claim 1, wherein said return contact projects radially from the inside face of said circular cylindrical tube with the distance of the return contact from the axis of said outlet electrode being greater than the radius of said electrode.

3. A variable inductor according to claim 1, contained in a gastight enclosure containing a dielectric gas.

* * * * *